US009195210B2

(12) United States Patent
Tanaka

(10) Patent No.: US 9,195,210 B2
(45) Date of Patent: Nov. 24, 2015

(54) DEVELOPER CONTAINER, PROCESS CARTRIDGE AND IMAGE FORMING APPARATUS

(71) Applicant: CANON KABUSHIKI KAISHA, Tokyo (JP)

(72) Inventor: Hiroyuki Tanaka, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/311,779

(22) Filed: Jun. 23, 2014

(65) Prior Publication Data

US 2014/0376971 A1 Dec. 25, 2014

(30) Foreign Application Priority Data

Jun. 24, 2013 (JP) ..... 2013-131887

(51) Int. Cl.
*G03G 21/18* (2006.01)
*G03G 21/16* (2006.01)
*G03G 15/08* (2006.01)

(52) U.S. Cl.
CPC ..... *G03G 21/1676* (2013.01); *G03G 15/0886* (2013.01); *G03G 21/18* (2013.01)

(58) Field of Classification Search
CPC combination set(s) only.
See application file for complete search history.

(56) References Cited

U.S. PATENT DOCUMENTS

2011/0052266 A1* 3/2011 Yoon et al. ..... 399/258
2014/0348547 A1 11/2014 Tanaka

FOREIGN PATENT DOCUMENTS

JP 2000-221766 8/2000

* cited by examiner

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

A developer container includes: a developer accommodating chamber provided with an opening; a first shutter, including a first portion-to-be-urged, movable between a closing position and an opening position; a second shutter, including a second portion-to-be-urged and being provided outside the first shutter with respect to the opening, movable between a closing position and an opening position; and a partitioning portion provided so as to block between the first and second portions-to-be-urged along moving ranges of the first and second portions-to-be-urged. Movement distances, when the first and second shutters are moved simultaneously from the closing positions, of the first and second shutters from the closing positions to the opening positions are different from each other so that after one of said first and second shutters reaches the opening position, the other shutter is moved to the opening position.

14 Claims, 9 Drawing Sheets

(a)

(b)

(a)

(b)

(a)

(b)

(a)

(b)

(a)

(b)

(a)

(b)

(a)

(b)

DEVELOPER CONTAINER, PROCESS CARTRIDGE AND IMAGE FORMING APPARATUS

FIELD OF THE INVENTION AND RELATED ART

The present invention relates to a developer container, a process cartridge and an image forming apparatus.

An image forming apparatus (a copying machine, a printer or the like) of a so-called electrophotographic type in which image formation is carried out by developing, with a developer, an electrostatic latent image formed on a photosensitive member by charging and exposure and then by transferring a resultant developer image onto a recording material (medium) needs supply of a fresh (new) developer correspondingly to the consumed developer. In such an image forming apparatus, a constitution in which a developer accommodating portion in a developing device is provided as a developer container, which is a separate member, detachably mountable to an apparatus main assembly of the image forming apparatus and in which the supply of the developer can be easily carried out by replacement of the developer container has been known.

The developer container is provided with an opening for permitting supply of the developer. The opening is connected with a developer supplying opening provided to the apparatus main assembly (developing device), so that the developer is supplied. The developer container is provided with a shutter for opening and closing the opening thereof, and is constituted so as to prevent the developer from leaking out through the opening, e.g., during transportation or the like by blocking the opening with the shutter when the developer container is demounted from the image forming apparatus.

As a structure of the shutter, in order to realize a more completely hermetic sealing of the opening, a double shutter structure in which a single opening is closed with two shutters has been known (Japanese Laid-Open Patent Application (JP-A) 2000-221766).

However, in the double shutter structure as disclosed in JP-A 2000-221766, by erroneous handling of a user, there is a possibility that the two shutters are simultaneously opened in a state in which the developer container is demounted from the image forming apparatus.

SUMMARY OF THE INVENTION

A principal object of the present invention is to provide a developer container, including two shutters, capable of suppressing an open state of an opening thereof by erroneously handling thereof by a user.

According to an aspect of the present invention, there is provided a developer container comprising: a developer accommodating chamber, provided with an opening, for accommodating a developer; a first shutter, including a first portion-to-be-urged, movable between a closing position where the opening is closed and an opening position where the opening is opened by urging the first portion-to-be-urged; a second shutter, including a second portion-to-be-urged and being provided outside the first shutter with respect to the opening, movable between a closing position where the opening is closed and an opening position where the opening is opened by urging the second portion-to-be-urged; and a partitioning portion provided so as to block between the first and second portions-to-be-urged along moving ranges of the first and second portions-to-be-urged, wherein movement distances, when the first and second shutters are moved simultaneously from the closing positions, of the first and second shutters from the closing positions to the opening positions are different from each other so that after one of the first and second shutters reaches the opening position, the other shutter is moved to the opening position.

According to another aspect of the present invention, there is provided a process cartridge, detachably mountable to an apparatus main assembly of an image forming apparatus, for performing an image forming process for forming an image on a recording material by a developer, wherein the above-mentioned developer container is detachably mounted to the process cartridge.

According to further aspect of the present invention, there is provided an image forming apparatus for forming the image on the recording material by the developer, wherein the above-mentioned developer container is detachably mounted to the apparatus main assembly or the process cartridge detachably mountable to the apparatus main assembly.

These and other objects, features and advantages of the present invention will become more apparent upon a consideration of the following description of the preferred embodiments of the present invention taken in conjunction with the accompanying drawings.

Figure 3:
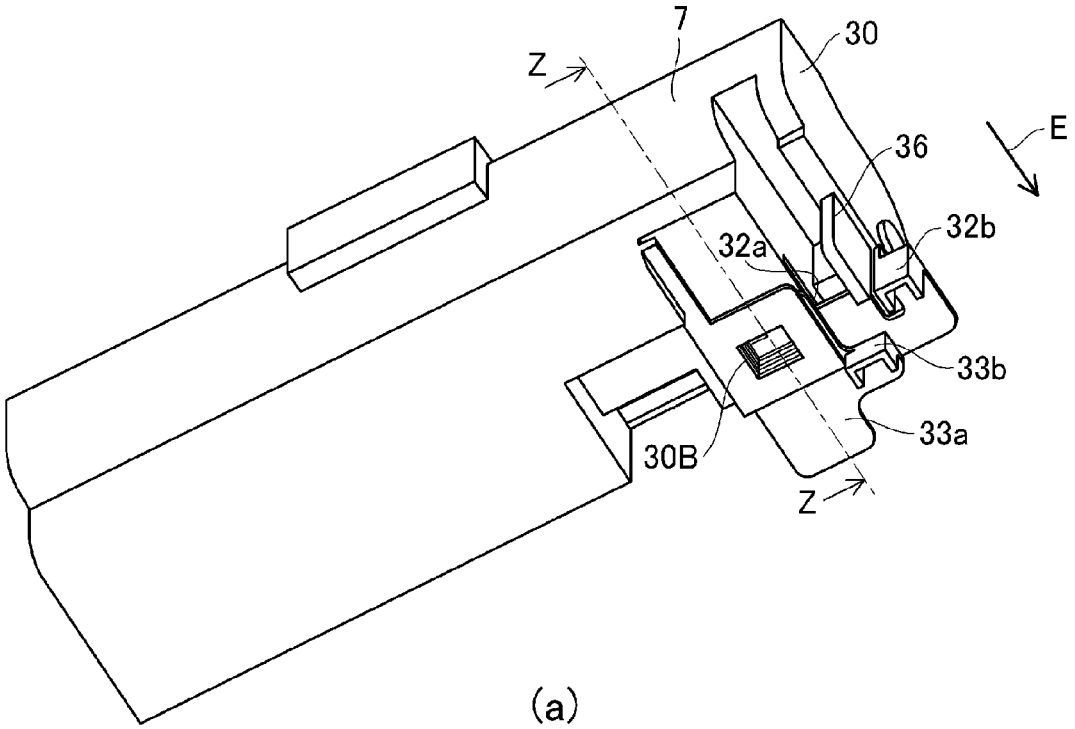
Figure 3:
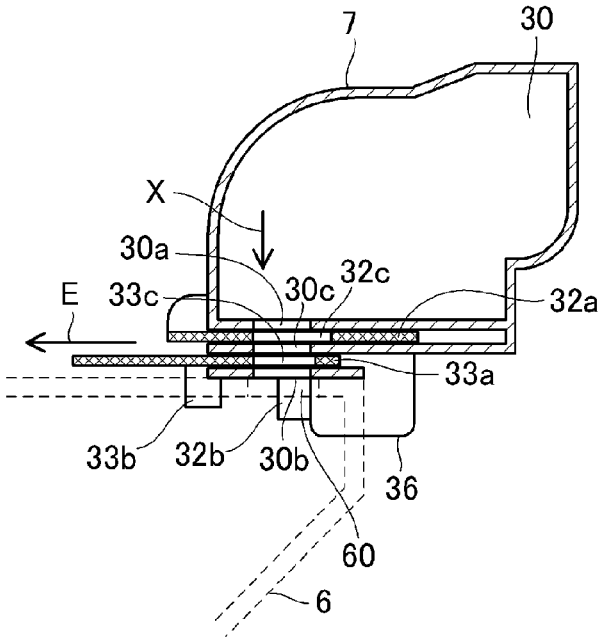
Figure 4:
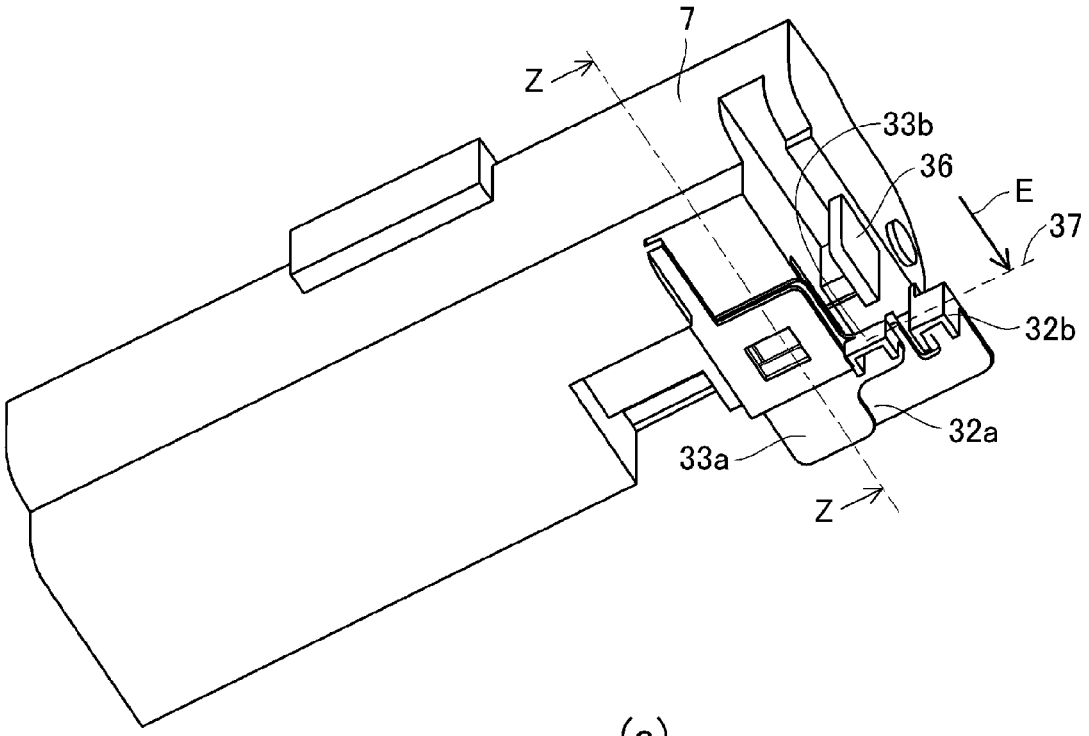
Figure 4:
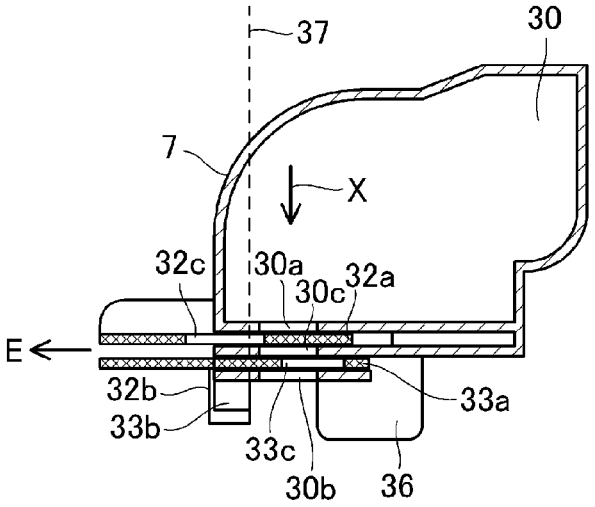

In each of FIGS. 3 and 4, (a) and (b) are schematic views each showing the structure of the developer container according to Embodiment 1.

Figure 5:
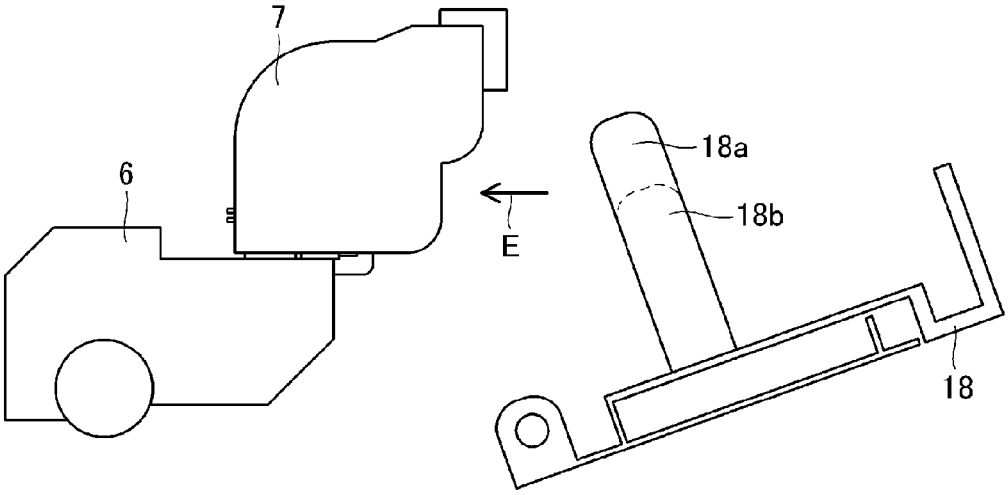
Figure 5:
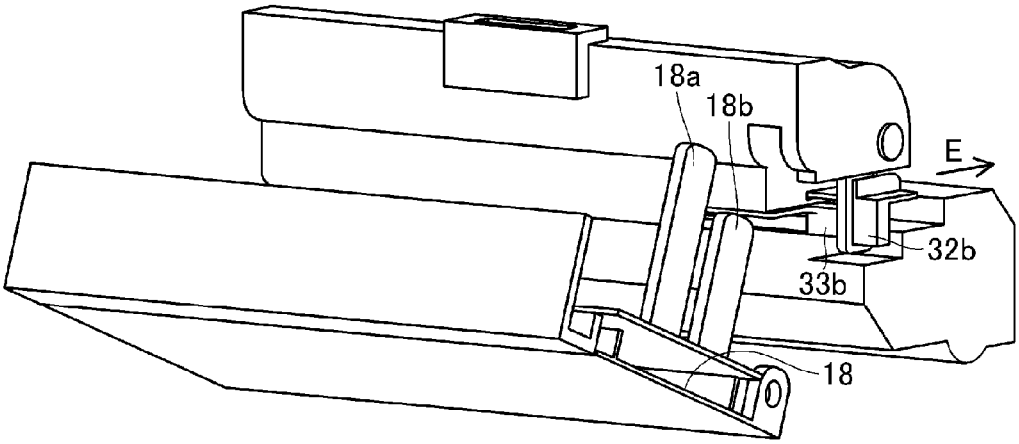
Figure 6:
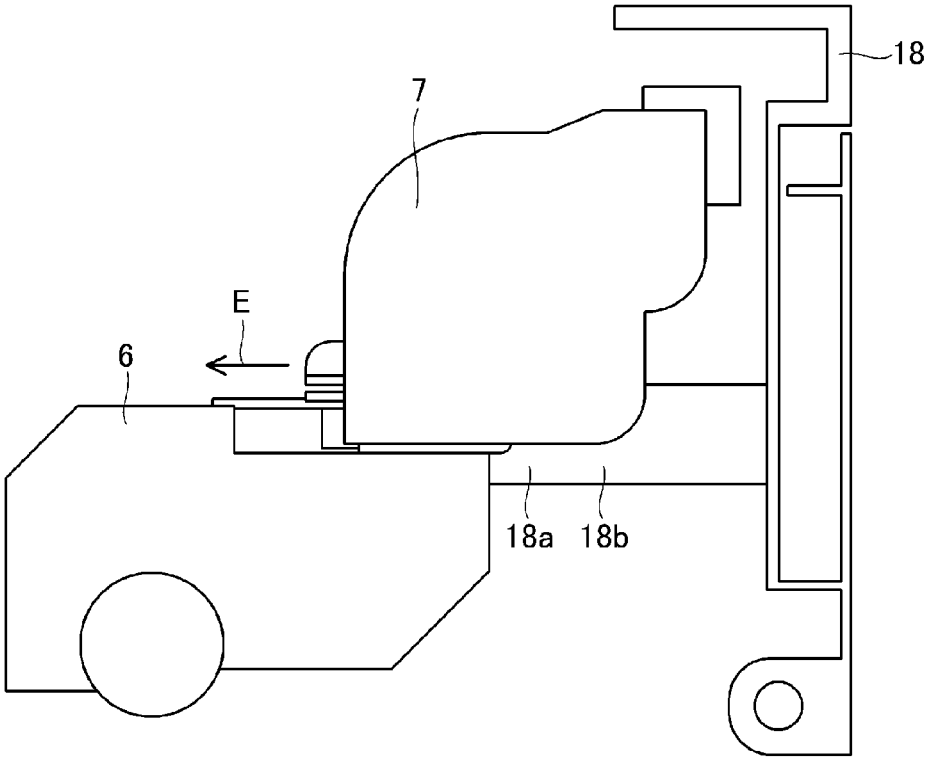
Figure 6:
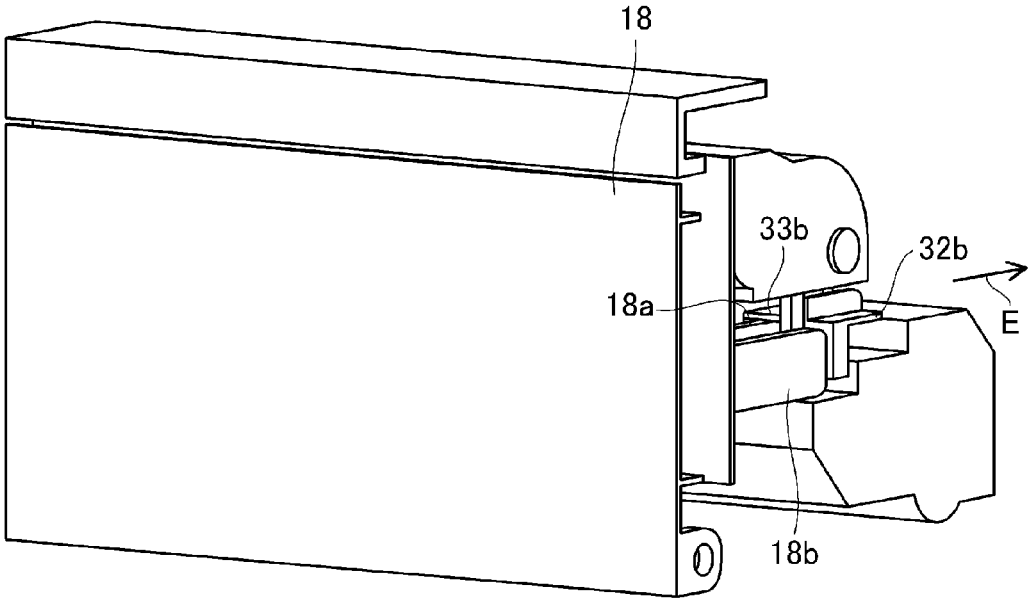

In each of FIGS. 5 and 6, (a) and (b) are schematic views each showing a shutter operating portion in Embodiment 1.

Figure 7:
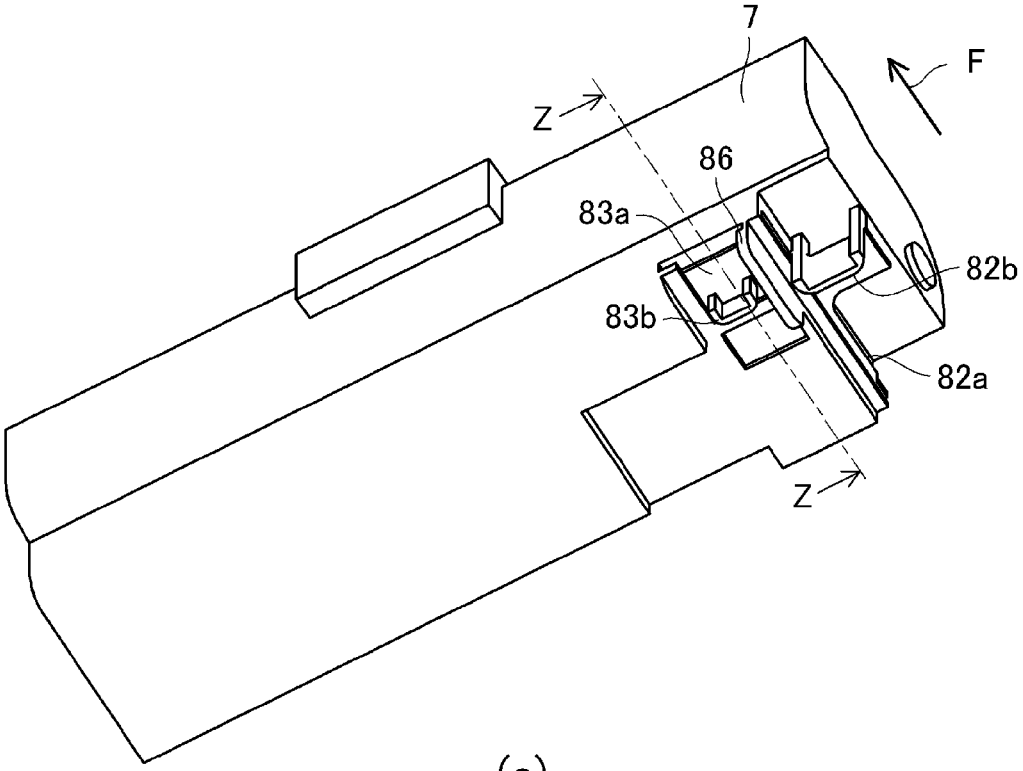
Figure 7:
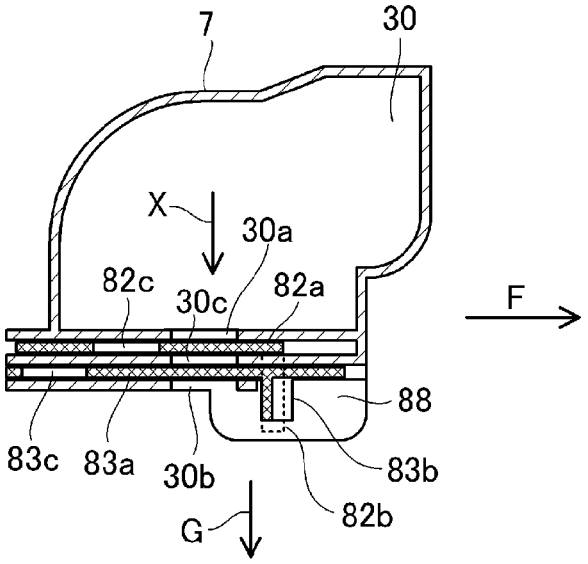
Figure 8:
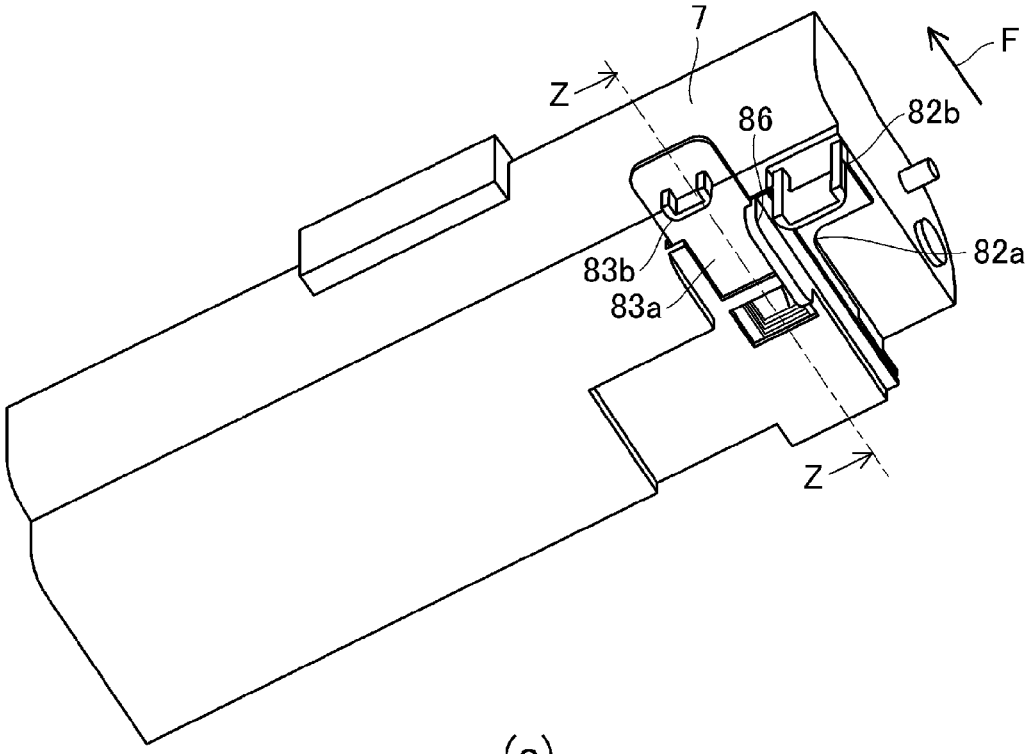
Figure 8:
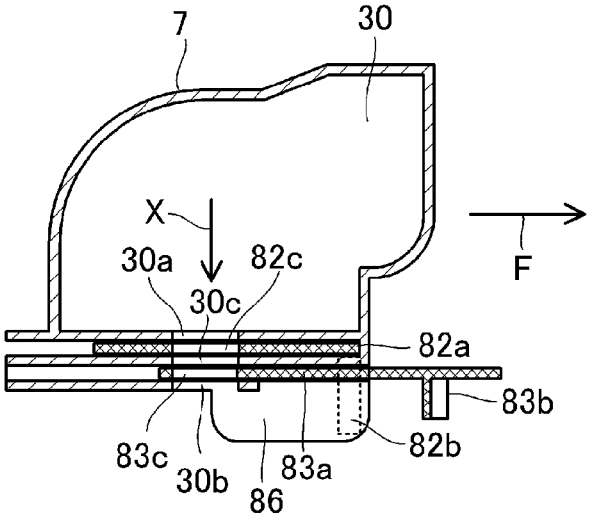

In each of FIGS. 7 and 8, (a) and (b) are schematic views showing a structure of a developer container according to Embodiment 2.

Figure 9:
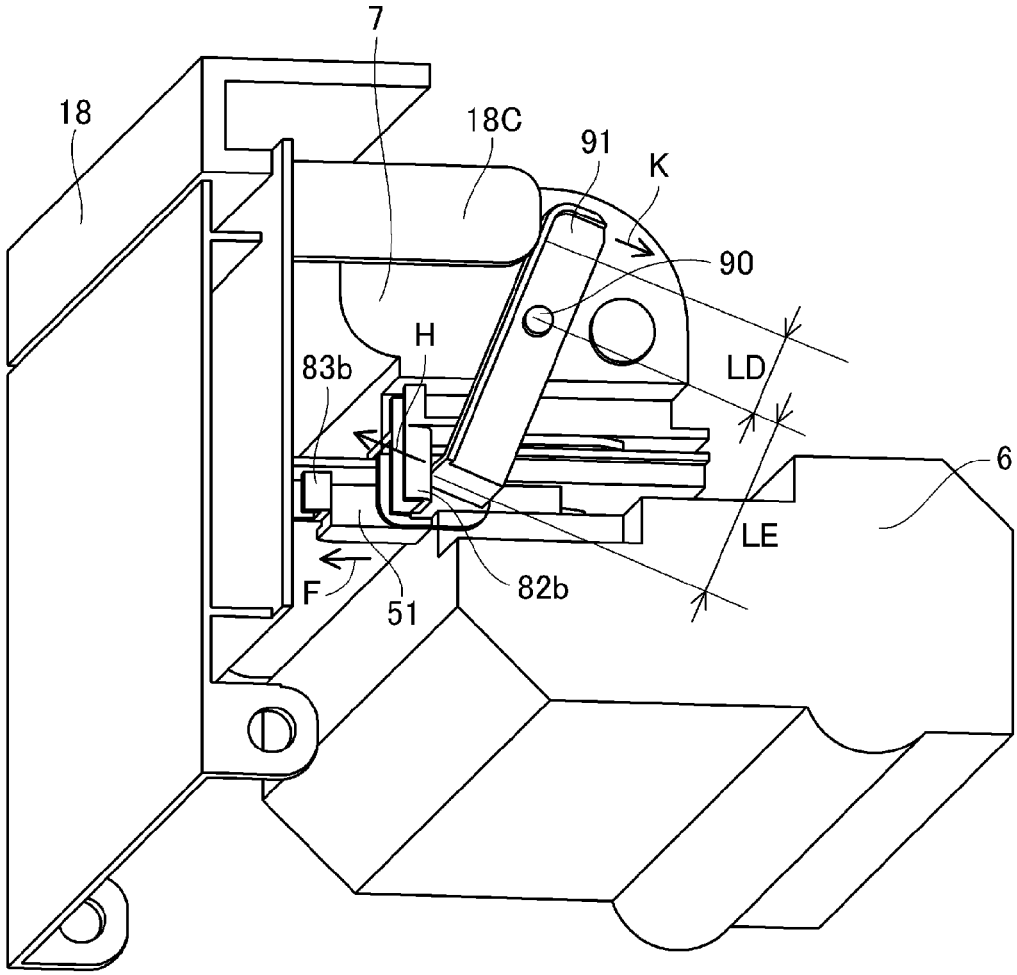

FIG. 9 is a schematic view showing a shutter operating portion in Embodiment 2.

DESCRIPTION OF THE EMBODIMENTS

Embodiments for carrying out the present invention will be specifically described with reference to the drawings. Dimensions, materials, shapes and relative arrangement of constituent elements described in the following embodiment should be appropriately be changed depending on structures and various conditions of devices (apparatuses) to which the present invention is applied. Accordingly, the scope of the present invention is not intended to be limited to the following embodiments.

(Embodiment 1)

Here, an image forming apparatus (electrophotographic image forming apparatus) forms an image on a recording material with a developer (toner) by using an electrophotographic image forming process. The image forming apparatus includes, e.g., an electrophotographic copying machine, an electrophotographic printer (such as LED printer or laser beam printer), an electrophotographic facsimile machine, an electrophotographic word processor, and a multi-function machine (such as multi-function printer) having functions of these machines. Further, the recording material is an object on which an image is to be formed, and is, e.g., a recording sheet, an OHP sheet and so on.

Further, a process cartridge is a cartridge prepared by integrally assembling an electrophotographic photosensitive drum and, as a process means actable on the photosensitive drum, at least one of a charging device, a developing means and a cleaning means into a unit. The process cartridge is detachably mountable to an image forming apparatus main assembly. In the following, the apparatus main assembly refers to an apparatus structural portion obtained by removing at least the process cartridge and a developer container from the structure of the apparatus main assembly.

<Image Forming Apparatus>

Figure 2:
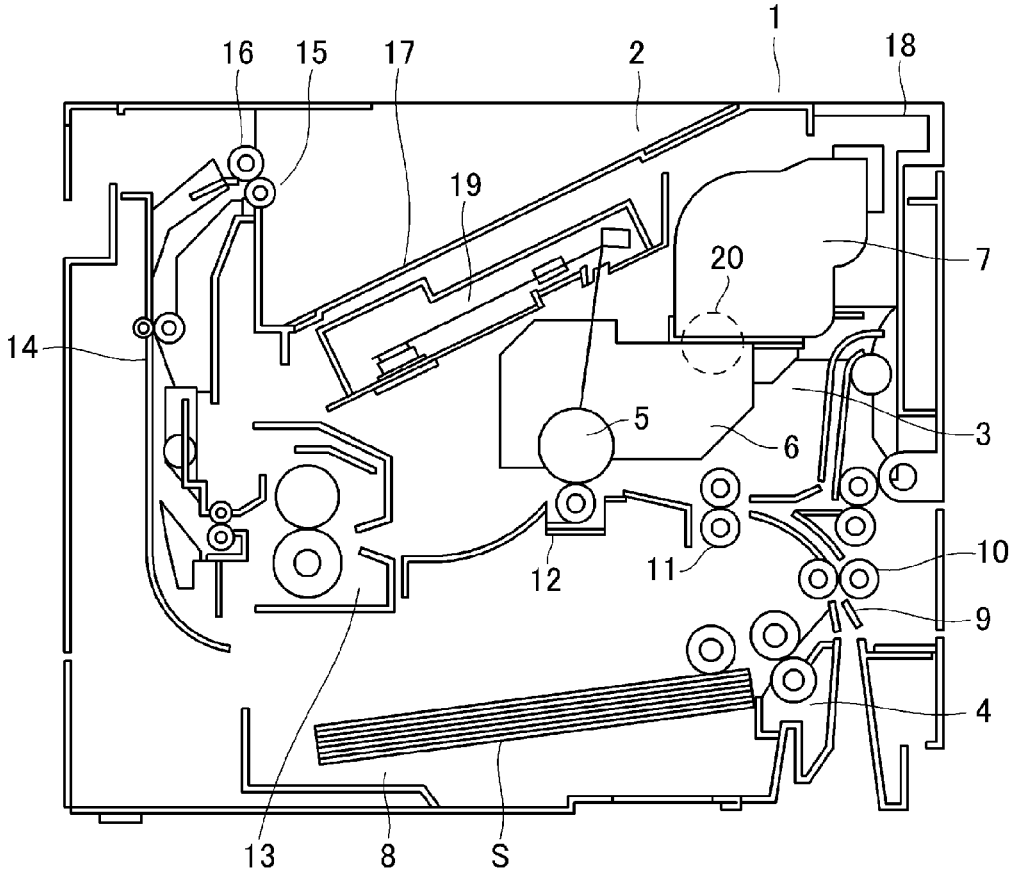
FIG. 2 is a schematic sectional view showing an image forming apparatus according to Embodiment 1.

With reference to FIG. 2, an image forming apparatus according to Embodiment 1 of the present invention will be described. FIG. 2 is a schematic sectional view showing a structure of the image forming apparatus in this embodiment. In this embodiment, as the image forming apparatus, the case where the present invention is applied to a monochromatic laser beam printer as a monochromatic image forming apparatus will be described. Incidentally, the present invention is also applicable to a four-color based full-color laser beam printer as an image forming apparatus for a plurality of colors.

An image forming apparatus 1 shown in FIG. 2 includes, in an apparatus main assembly 2, an image forming portion 3, a sheet-feeding device 4, a fixing device 13 and a paper-discharging device 15. The image forming portion 3 forms an image, by an electrophotographic image forming process, on a sheet S as a recording material (medium) fed by the sheet-feeding device 4. The fixing device 13 fixes the image, formed at the image forming portion 3, on the sheet S, and then the paper-discharging device 15 discharges the sheet S, on which the image is fixed, onto a paper discharge tray 17.

The image forming portion 3 includes a photosensitive drum 5 as an image bearing member, a developing device 6, and a developer container (developer accommodating container) 7 for supplying a developer to the developing device 6 via a connecting portion 20, and a laser scanner 19 for exposing the photosensitive drum 5 to light. During image formation, the photosensitive drum 5 is exposed to light by the laser scanner 19 to form a latent image on the surface of the photosensitive drum 5, and thereafter this latent image is developed, so that an image with a developer (i.e., a developer image) is formed on the surface of the photosensitive drum 5.

The sheet-feeding device 4 includes a paper-feeding cassette 8 provided detachably mountable to the apparatus main assembly 2 and a feeding roller 9, provided over the paper-feeding cassette 8, for feeding to sheet S accommodated in the paper-feeding cassette 8.

The sheet-feeding device feeds the sheet S, accommodated in the paper-feeding cassette 8, by the feeding roller 9 and thereafter conveys the sheet S to a registration roller pair 11 by a conveying roller pair 10 in parallel to the image forming operation with the developer at the above-described image forming portion 3. Incidentally, after being conveyed to the registration roller pair 11 as described above, the sheet S is conveyed by the registration roller pair 11 at predetermined timing to a transfer portion formed by the photosensitive drum 5 and the transfer roller 12.

Onto the sheet S conveyed to the transfer portion, the image formed on the surface of the photosensitive drum 5 is transferred at the transfer portion. Thereafter, the sheet S is conveyed into the fixing device 13, and is heated and pressed in the fixing device 13, so that the image is fixed on the sheet S. The sheet S is, after the image is fixed thereon, discharged onto the paper discharge tray 17, provided at an upper surface of the apparatus main assembly 2, via a paper-discharging path by a paper-discharging roller pair 16 provided in the paper(sheet)-discharging device 15.

<Developer Container>

Figure 1:
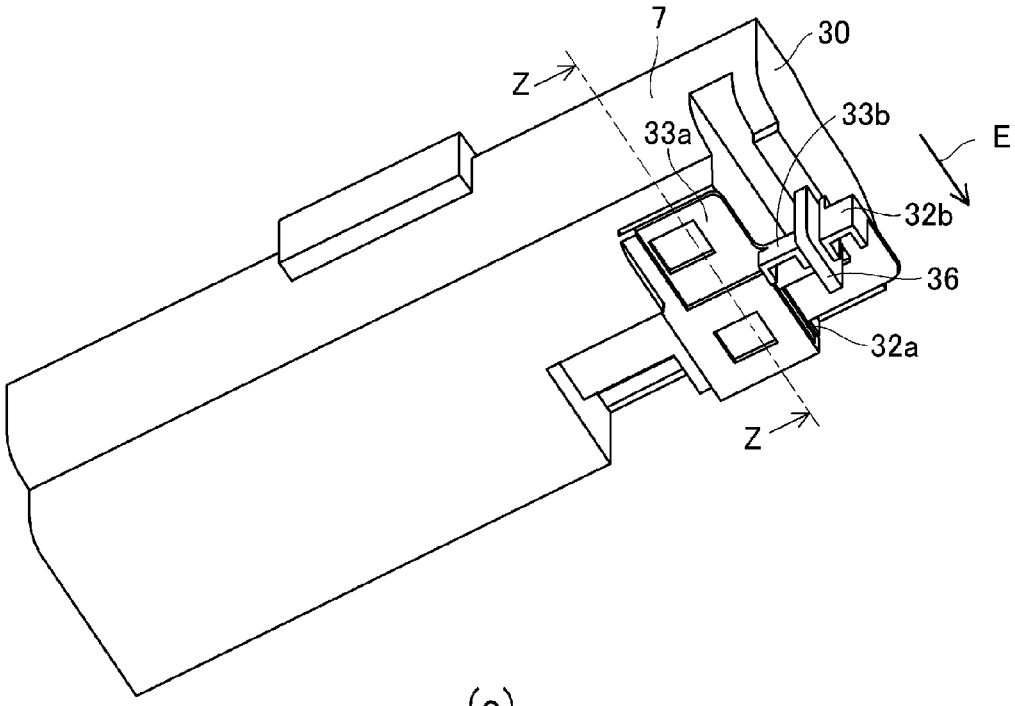
In FIG. 1, (a) and (b) are schematic views showing a structure of a developer container according to Embodiment 1.
Figure 1:
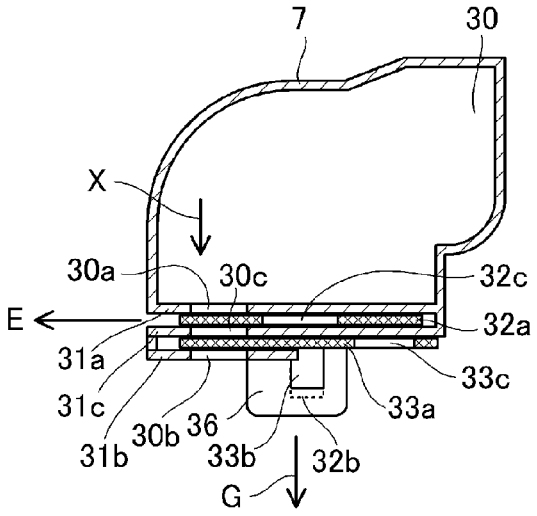

With reference to FIGS. 1, 3 and 4, the developer container 7 according to Embodiment 1 will be described. In FIG. 1, (a) and (b) are schematic views showing the structure of the developer container 7 in this embodiment and showing a closed state of shutters, in which (a) is a perspective view of showing an opening and a periphery thereof, and (b) is a cross-sectional view, of the opening and the periphery thereof, taken along a line perpendicular to a longitudinal direction (arrow Z direction of (a) (Z-Z cross-sectional view of (a)).

In FIG. 1, (a) and (b) are schematic views showing the structure of the developer container 7 in this embodiment and showing an open state of shutters connected with the developing device 6, in which (a) is a perspective view of showing an opening and a periphery thereof, and (b) is a cross-sectional view, of the opening and the periphery thereof, taken along a line perpendicular to a longitudinal direction (arrow Z direction of (a) (Z-Z cross-sectional view of (a)).

In FIG. 1, (a) and (b) are schematic views, showing the structure of the developer container 7 in this embodiment, for illustrating a relationship between movement amounts of two shutters and a change in an open and closed state, in which (a) is a perspective view of showing an opening and a periphery thereof, and (b) is a cross-sectional view, of the opening and the periphery thereof, taken along a line perpendicular to a longitudinal direction (arrow Z direction of (a) (Z-Z cross-sectional view of (a)).

The developer container 7 in this embodiment is provided with openings 30*a* to 30*c* and a developer accommodating chamber 30 in which the developer is accommodated. The openings 30*a* to 30*c* for the developer accommodating chamber 30 are constituted so as to be openable and closable by shutters 32*a* and 33*a* as first and second shutters, respectively. A fixing rib 36 as a partitioning portion is formed on an outer surface of the developer accommodating chamber 30 so as to block between a moving range of each of the shutters 32*a* and 33*a*.

The openings 30*a* to 30*c* consist of a first opening 30*a* provided closest to an inside of the developer accommodating chamber 30, a second opening 30*b* provided remotest from the inside of the developer accommodating chamber 30, and a third opening 30*c* provided between the first and second openings 30*a* and 30*b*. The opening 30*c* is formed as a through hole provided in a plate-like portion 31*c* provided with a gap in parallel to an outer surface of a wall portion 31*a*, as a wall portion of the developer accommodating chamber 30, where the opening 30*a* is provided. The opening 30*b* is formed as a through hole provided in a plate-like portion 31*b* provided with a gap in parallel to the plate-like portion 31*c* in an outside of the plate-like portion 31*c*.

The respective openings 30*a* to 30*c* are provided at positions where they overlap with each other along an opening direction (arrow X direction of (b) of FIG. 1). In a state in which all the openings 30*a* to 30*b* are not closed by any of the two shutters 32*a* and 33*a*, a state in which the inside of the developer accommodating chamber 30 opens to the outside of the developer accommodating chamber 30 is created.

The shutters 32*a* and 33*a* are a plate-like member, and are assembled at the gap between the wall portion 31*a* provided with the opening 30*a* and the plate-like portion 31*c* provided with the opening 30*c*, and between the plate-like portion 31*c* provided with the opening 30*c* and the plate-like portion 31*b* provided with the opening 30*b*, respectively. That is, the shutter 32*a* is disposed between the wall portion 31*a* and the plate-like portion 31*c*, and the shutter 33*a* is disposed between the plate-like portions 31*c* and 31*b*.

Levers 32*b* and 33*b* are provided, as operating portions (portions-to-be-urged) for sliding and moving the shutters 32*a* and 33*a*, respectively, in the above-described gaps, integrally with each of the shutters 32*a* and 33*a* so as to be projected from the outer surface of the developer container 7. By urging (pressing) the levers 32*b* and 33*b*, the shutters 32*a* and 33*a* are constituted so as to be slidable and movable independently along the gaps between the surfaces of the wall portion 31*a* and the plate-like portion 31*c* and between the surfaces of the plate-like portions 31*c* and 31*b*, respectively (in arrow E direction of FIG. 1).

Feeding openings 32*c* and 33*c* are through holes provided in the shutters 32*a* and 33*a*, respectively, and are provided so as to be capable of overlapping with the openings 30*a* to 30*c* along the opening direction (arrow X direction of (b) of FIG. 1) of the openings 30*a* to 30*c*. When the shutters 32*a* and 33*a* are located at positions where both the feeding openings 32*c* and 33*c* are placed in an overlapping state with the openings 30*a* to 30*c*, the inside of the developer accommodating chamber 30 opens to the outside of the developer accommodating chamber 30.

The shutters 32*a* and 33*a* are urged in a direction opposite to the arrow E direction by unshown springs, and in a free state in which no external force is applied, are constituted so as to maintain a closed state in which the openings 30*a* to 30*c* are completely closed as shown in FIG. 1. When each of the shutters 32*a* and 33*a* is slid and moved to the closing position by applying an external force to an associated one of the levers 32*b* and 33*b*, as shown in FIG. 3, the openings 30*a* to 30*c* are placed in an open state. As a result, the developer container 7 is capable of feeding the developer, accommodated in the developer accommodating chamber 30, in an outward direction (arrow X direction).

The fixing rib 36 is provided between the moving ranges of the levers 32*b* and 33*b* of the shutters 32*a* and 33*a*, along a movement direction (arrow E direction of FIG. 1) of the levers 32*b* and 33*b*. The fixing rib 36 is constituted so that a height thereof with respect to a direction perpendicular to the movement directions of the levers 32*b* and 33*b* (i.e., with respect to arrow G direction of (b) of FIG. 1 perpendicular to both the arrow E direction and the arrow E direction of (a) of FIG. 1) is higher than heights of the levers 32*b* and 33*b*. Further, the fixing rib 36 is, as shown in FIG. 1, provided so that the fixing rib 36 is broader than each of widths of the levers 32*b* and 33*b* and blocks between the levers 32*b* and 33*b* in a range of a positional relationship such that the shutters 32*a* and 33*a* are located at least at the closing positions within the moving ranges thereof.

As shown in FIG. 3, the developer container 7 is mounted at a predetermined position of the apparatus main assembly 2 (developing device 6), and at the same time the shutters 32*a* and 33*a* are opened, whereby the openings 30*a* to 30*c* are placed in a state in which the openings 30*a* and 30*c* communicate with a developer supplying opening 60 of the developing device 6. As a result, the developer container 7 is capable of supplying (feeding) the developer into the developing device 6.

<Opening and Closing of Shutters>

With reference to FIGS. 5 and 6, a shutter operating portion for opening and closing the shutters 32*a* and 33*a* of the developer container 7 in the apparatus main assembly 2. In FIG. 5, (a) and (b) are schematic views showing a structure of the shutter operating portion in this embodiment, in which (a) is a side view in a state before an openable door 18 is closed after the developer container 7 is mounted in the apparatus main assembly 2 (developing device 6), and (b) is a perspective view in the state. In FIG. 6, (a) and (b) are schematic views showing the structure of the shutter operating portion in this embodiment, in which (a) is a side view in a state after the openable door 18 is opened, and (b) is a perspective view in the state.

The developer container 7 is constituted so as to be detachably mountable to the apparatus main assembly 2 (developing device 6) by opening the openable door 18 as a cover member provided to the apparatus main assembly 2. The openable door 18 is provided with projected portions 18*a* and 18*b* as the shutter operating portion (urging portion).

With respect to the developer container 7, as shown in FIG. 5, in a state in which the openable door 18 is open, the shutters 32*a* and 33*a* are located at the closing positions, so that openings 30*a* to 30*c* are closed. The openable door 18 is, when being closed by an operation of a user, rotated relative to the apparatus main assembly 2 while the projected portions 18*a* and 18*b* push the levers 32*b* and 33*b* in an arrow E direction (which is the same direction as the arrow E direction in (a) of FIG. 1 and the like), thus moving the shutters 32*a* and 33*a* from opening positions to the closing positions (FIG. 6). As a result, the openings 30*a* to 30*c* are opened, thus being placed in a communication state with the developer supplying opening 60 of the developing device 6.

In this way, the developer container 7 is constituted so that the state in which the shutters 32*a* and 33*a* are closed until the openable door 18 is closed. As a result, leakage of the developer during an exchanging (replacing) operation of the developer container 7 is prevented.

The projected portions 18*a* and 18*b* are constituted so that projected amounts (heights) thereof are different depending on movement amounts of the levers 32*b* and 33*b* pushed by the projected portions 18*a* and 18*b*, respectively (i.e., movement amounts of the shutters 32*a* and 32*b* from the closing positions to the opening positions).

<Excellent Points of this Embodiment>

As described above, the developer container 7 is provided with the fixing rib 36 which is higher than the levers 32*b* and 33*b* and which is wider than the levers 32*b* and 33*b* with respect to the movement direction, so that the user does not readily touch the levers 32*b* and 33*b* at the same time. That is, e.g., in a state such that the user holds the developer container 7, a constitution in which it is difficult to handle the two shutters simultaneously is employed. As a result, it is possible to suppress erroneous opening of the shutters 32*a* and 33*a* by the user.

Further, a constitution in which the opening is not opened even when only one of the levers is handled is employed. Further, a constitution in which even when the two shutters are handled simultaneously, the two shutters are different from each other in movement distance from the closing position to the opening position and are not located at their opening positions at the same time, and therefore are not opened immediately is employed. Accordingly, even if the user touches both the levers 32*b* and 33*b*, there is a low possibility that the shutters 32*a* and 33*a* are operated to be moved to their positions.

Further, as shown in FIG. 4, in the case where the positions of the levers are aligned with each other along a direction perpendicular to the movement directions, the shutters are not placed in a state in which the opening is opened. That is, the positions of the levers in the open state are different from each other, and therefore in the case where the user intends to open the shutters by handling the levers, the user is required to independently adjust the position of each of the levers. Accordingly, unless the user intentionally handles the levers, a plurality that both the shutters are moved to the opening positions simultaneously is low.

As described above, according to this embodiment, with respect to the developer container 7 provided with two shutters, it is possible to suppress the opening of the shutters by erroneous handling of the levers by the user, so that a possibility of leakage of the developer from the developer container 7 can be considerably alleviated.

<Other Embodiments>

In this embodiment, the feeding openings 32*a* and 33*c* of the shutters 32*a* and 33*a* are provided in the form of the through holes, but are not limited thereto. If the feeding openings are in the form such that the feeding openings are capable of opening the portion, various constitutions can be employed. For example, in place of the through holes, the form such as cut-away portions may also be employed, and a constitution in which one of the shutters is provided with the through hole and the other shutter is provided with the cut-away portion may also be employed.

(Embodiment 2)

With reference to FIGS. 7 to 9, the developer container 7 according to Embodiment 2 will be described. In this embodiment, a point different from Embodiment 1 will be principally described. Constituent elements similar to those in Embodiment 1 are represented by the same reference numerals or symbols, and will be appropriately omitted from description. The matters which are not described in this embodiment are the same as those in Embodiment 1.

In FIG. 7, (a) and (b) are schematic views showing the structure of the developer container 7 in this embodiment and showing a closed state of shutters, in which (a) is a perspective view of showing an opening and a periphery thereof, and (b) is a cross-sectional view, of the opening and the periphery thereof, taken along a line perpendicular to a longitudinal direction (arrow Z direction of (a) (Z-Z cross-sectional view of (a)).

In FIG. 8, (a) and (b) are schematic views showing the structure of the developer container 7 in this embodiment and showing an open state of shutters connected with the developing device 6, in which (a) is a perspective view of showing an opening and a periphery thereof, and (b) is a cross-sectional view, of the opening and the periphery thereof, taken along a line perpendicular to a longitudinal direction (arrow Z direction of (a) (Z-Z cross-sectional view of (a)).

The developer container 7 in this embodiment has a constitution in which the movement directions of the shutters during opening and closing are opposite to those for the developer container 7 in Embodiment 1.

In this embodiment, with respect to the developer container 7, similarly as in Embodiment 1, the openings 30*a* to 30*c* for the developer accommodating chamber 30 are opened and closed by shutters 82*a* and 83*a* as first and second shutters, respectively. The sheets 82*a* and 83*a* are, similarly as in the case of the shutters 32*a* and 33*a* in Embodiment 1, integrally provided with levers 82*b* and 83*b* and feeding openings 82*c* and 83*c* for feeding the developer. A fixing rib 86 as a partitioning portion is formed on an outer surface of the developer accommodating chamber 30 so as to block between a moving range of each of the shutters 82*a* and 83*a*.

The shutters 82*a* and 83*a* are urged in a direction opposite to an arrow F direction by unshown springs, and in a free state in which no external force is applied, are constituted so as to maintain a closed state in which the openings 30*a* to 30*c* are completely closed as shown in FIG. 7. When each of the shutters 82*a* and 83*a* is slid and moved to the closing position by applying an external force to an associated one of the levers 82*b* and 83*b*, as shown in FIG. 8, the openings 30*a* to 30*c* are placed in an open state. As a result, the developer container 7 is capable of feeding the developer, accommodated in the developer accommodating chamber 30, in an outward direction (arrow X direction).

As shown in (b) of FIG. 7, the fixing rib 86 has a shape such that the fixing rib 86 is projected more than (i.e., is larger than) the s 82*b* and 83*b* with respect to both the shutter opening and closing direction (arrow F direction) and an opening direction (arrow G direction) in a state in which the shutters 82*a* and 83*a* are located at their closing positions.

<Opening and Closing of Shutters>

FIG. 9 is a schematic perspective view showing a structure of a shutter operating portion in this embodiment in a perpendicular to in which the developer container 7 is mounted in the apparatus main assembly 2 (developing device 6) and then the openable door 18 is closed. In this embodiment, the developing device 6 is provided with a projected portion 51 as an urging portion. Further, an unshown frame of the apparatus main assembly 2 is provided, as an urging portion, with a lever 91 rotatable about a rotation shaft 90.

First, when the developer container 7 is mounted to the developing device 6, the lever 83*b* is pushed in the arrow F direction by the projected portion 51, so that the state of the shutter 83*a* is changed from a state in which the shutter 83*a* blocks between the openings 30*a* and 30*b*.

Then, when the openable door 18 is closed, the lever 91 is urged in an arrow K direction by a projected portion 18C provided on the openable door 18. The lever 91 is rotated about the rotation shaft 90 to urge the lever 82*b* in an arrow H direction. The lever 82*b* is pushed, whereby the shutter 82*a* is moved in the arrow F direction, and thus the state of the shutter 82*a* is changed from the state in which the shutter 82*a* blocks between the openings 30*c* and 30*b* to an open state. As a result, the openings 30*a* to 30*c* are placed in an open state.

<Excellent Points of this Embodiment>

Also in this embodiment, similarly as in Embodiment 1, with respect to the developer container 7 provided with two shutters, it is possible to suppress the opening of the shutters by erroneous handling of the levers by the user, so that a possibility of leakage of the developer from the developer container 7 can be considerably alleviated.

Incidentally, according to this embodiment, in addition to the functional effect similar to that in Embodiment 1, it is possible to reduce a force required for the opening and closing operation of the openable door 18. That is, in Embodiment 1, there are the two levers 32*b* and 33*b* moved by the closing operation of the openable door 18, whereas in this embodiment, only one lever 82*b* is moved. Further, as shown in FIG. 9, by adjusting lengths LD and LE from a rotation center (rotation shaft 90) of the lever 91, it is possible to adjust an operating force of the openable door 18 and an operation amount of the operating lever 91.

Incidentally, the above-described embodiments can be applied by combining their constitutions with each other.

According to the present invention, in the developer container provided with the two shutters, it is possible to suppress the opening of the opening due to erroneous handling by the user.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 131887/2013 filed Jun. 24, 2013, which is hereby incorporated by reference.

What is claimed is:

1. A developer container comprising:

a developer accommodating chamber, provided with an opening, for accommodating developer;

a first shutter including a first portion-to-be-urged, said first shutter being movable between a closed position where the opening is closed and an open position where the opening is opened by urging said first portion-to-be-urged;

a second shutter including a second portion-to-be-urged, said second shutter being provided outside said first shutter with respect to the opening, and said second shutter being movable between a closed position where the opening is closed and an open position where the opening is opened by urging said second portion-to-be-urged; and a partitioning portion provided between said first and second portions-to-be-urged with respect to a longitudinal direction of the developer container and along moving ranges of said first and second portions-to-be-urged, wherein movement distances of said first and second shutters from the closed positions to the open positions are different from each other so that after one of said first and second shutters reaches its open position, the other of said first and second shutters reaches its open position.

2. A developer container according to claim 1, wherein movement directions of said first and second portions-to-be-urged are the same, and wherein, when positions of said first and second portions-to-be-urged are aligned with each other along a direction perpendicular to the movement directions, said first and second shutters are configured so as not to place the opening in an open state.

3. A developer container according to claim 1, wherein said partitioning portion has a height, with respect to a direction perpendicular to the movement directions of said first and second portions-to-be-urged, more than heights of said first and second portions-to-be-urged.

4. A developer container according to claim 1, wherein said partitioning portion blocks between said first and second portions-to-be-urged in at least ranges, of the moving ranges, in which said first and second shutters are located at the closed positions, respectively, where the opening is closed.

5. A developer container according to claim 1, wherein at least one of said first and second shutters is provided with a through hole, and opens the opening at a position where the through hole overlaps with the opening, and blocks the opening at a position where the through hole does not overlap with the opening.

6. A developer container according to claim 1, wherein the opening includes a first opening and a second opening positioned outside the first opening, and wherein said first shutter is provided so as to be capable of opening and closing the first opening, and said second shutter is provided so as to be capable of opening and closing the second opening.

7. A developer container according to claim 6, wherein the opening includes a third opening between the first and second openings, and wherein at least one of said first and second shutters is provided so as to be capable of opening and closing the third opening.

8. A developer container according to claim 1, which is detachably mountable to (i) a main assembly of an image forming apparatus, for forming an image on a recording material, or (ii) a process cartridge detachably mountable to the main assembly, so that the opening communicates with a developer supplying opening provided to the main assembly or the process cartridge.

9. A developer container according to claim 8, which is to be mounted to the main assembly or the process cartridge by urging said first and second portions-to-be-urged by an urging portion, provided to the main assembly or the process cartridge, to open the opening.

10. A developer container according to claim 8, wherein when a cover member of the main assembly is closed after said developer container is mounted to the main assembly or the process cartridge, the opening is opened by urging said first and second-portions-to-be-urged by an urging portion provided to the main assembly or the process cartridge.

11. A developer container according to claim 8, which is to be mounted to the main assembly or the process cartridge by urging either one of said first and second portions-to-be-urged by an urging portion, provided to the main assembly or the process cartridge, to move an associated shutter to the open position, wherein when a cover member of the main assembly is closed after said developer container is mounted to the main assembly or the process cartridge, the opening is opened by urging the other one of said first and second portions-to-be-urged by the urging portion to move an associated shutter to the open position.

12. A process cartridge detachably mountable to a main assembly of an image forming apparatus, for performing an image forming process for forming an image on a recording material with developer, said process cartridge comprising:

a developer container according to claim 1 detachably mounted thereto.

13. An image forming apparatus for forming an image on a recording material by a developer, said image forming apparatus comprising:

a developer container according to claim 1 detachably mounted to a main assembly of said image forming apparatus or a process cartridge detachably mountable to said main assembly.

14. A developer container comprising:

a developer accommodating chamber, provided with an opening, for accommodating developer;

a first shutter including a first-portion-to-be-urged, said first shutter being movable between a closed position where the opening is closed and an open position where the opening is opened by urging said first-portion-to-be-urged;

a second shutter, including a second-portion-to-be-urged, said second shutter being provided outside said first shutter with respect to the opening, and said second shutter being movable between a closed position where the opening is closed and an open position where the opening is opened by urging said second-portion-to-be-urged; and a partitioning portion provided between said first and second-portions-to-be-urged, wherein (i) movement distances of said first and second shutters from the closed positions to the open positions are different from each other and (ii) the movement directions toward the open positions of said first and second portions-to-be-urged are the same so that after one of said first and second shutters reaches its open position, the other of said first and second shutters reaches its open position.

* * * * *